US010828750B2

(12) United States Patent
Cheng

(10) Patent No.: US 10,828,750 B2
(45) Date of Patent: Nov. 10, 2020

(54) VISE

(71) Applicant: Chin-Chuen Cheng, Miaoli (TW)

(72) Inventor: Chin-Chuen Cheng, Miaoli (TW)

(73) Assignee: Yun Kuan Enterprises Co., Ltd., Miaoli (TW)

( * ) Notice: Subject to any disclaimer, the term of this patent is extended or adjusted under 35 U.S.C. 154(b) by 137 days.

(21) Appl. No.: 16/354,109

(22) Filed: Mar. 14, 2019

(65) Prior Publication Data

US 2019/0210194 A1 Jul. 11, 2019

(51) Int. Cl.
*B25B 5/10* (2006.01)
*B25B 5/02* (2006.01)

(52) U.S. Cl.
CPC ..... *B25B 5/102* (2013.01); *B25B 5/02* (2013.01)

(58) Field of Classification Search
CPC ..... B25B 5/102; B25B 5/02; B25B 1/02
See application file for complete search history.

(56) References Cited

U.S. PATENT DOCUMENTS 3,218,058 A * 11/1965 Smith ..... B25B 5/02 269/166
5,094,131 A * 3/1992 Sorensen ..... B25B 5/006 81/152
5,197,360 A * 3/1993 Wooster, Jr. ..... B25B 5/068 269/170
6,412,767 B1 * 7/2002 Beckmann ..... B25B 5/102 269/166
7,699,297 B2 * 4/2010 Cicenas ..... B25B 5/068 269/6
D884,448 S * 5/2020 Weinberg ..... D8/72

* cited by examiner

*Primary Examiner* — Christopher R Harmon

(57) ABSTRACT

A vise is provided with a movable jaw including a threaded hole in a channel; an actuator in the channel and having a hole through an arcuate surface; a limit member in the channel and having front and intermediate cavities and a rear groove; a first plate member in the front cavity and having a through hole; a third plate member in the intermediate cavity and having a through hole; and a second plate member sandwiched between the first plate member and the third plate member and having a hole through a convex surface; and a slide sleeve including a tunnel, an intermediate thread engaging the threaded hole, a front annular flange in the rear groove, a front recess surrounded by the annular flange, and a biasing member in the front recess and urging against the third plate member; a handle; and a stationary jaw including a slide bar.

1 Claim, 6 Drawing Sheets

VISE

BACKGROUND OF THE INVENTION

1. Field of the Invention

The invention relates to vises and more particularly to a vise having improved characteristics.

2. Description of Related Art

A conventional vise for clamping and holding various sizes and shapes of workpieces is equipped with inserts for removable mounting on the jaw faces. The inserts have serrated engaging surfaces. Further, the vise has an arrangement to facilitate positioning the workpiece in a variety of positions.

While the device enjoys its success in the market, continuing improvements in the exploitation of vise of this type are constantly being sought.

SUMMARY OF THE INVENTION

It is therefore one object of the invention to provide a vise comprising a movable jaw including a clamping surface; a lengthwise channel; a threaded hole disposed in a rear portion of the lengthwise channel; an actuator disposed in a front portion of the lengthwise channel and having a rear, arcuate surface and a through hole through the rear, arcuate surface; a limit member disposed in an intermediate portion of the lengthwise channel and having a front cavity, an intermediate cavity, and a rear groove; a first plate member disposed in the front cavity and being adjacent to the actuator, the first plate member having a through hole; a third plate member disposed in the intermediate cavity and having a through hole; and a second plate member disposed between the first plate member and the third plate member and engaged with both the first and second plate members, the second plate member having a rear, convex surface engaging the third plate member, and a through hole through the rear, convex surface; a slide sleeve including an axial tunnel, an intermediate thread threadedly secured to the threaded hole, a front annular flange disposed in the rear groove, a front recess surrounded by the annular flange, a biasing member partially disposed in the front recess and urging against the third plate member, a plurality of equally spaced keys extending between the intermediate thread and a rear end of the slide sleeve, and two opposite holes through the keys wherein the slide sleeve projects rearward out of the movable jaw; a handle including two opposite holes aligned with the opposite holes, a plurality of spaced troughs on a front portion of an inner surface with the keys positioned therein, and two fasteners driven through the opposite holes to fasten the handle and the slide sleeve; and a stationary jaw including a clamping surface and a slide bar extending rearward through the through hole of the actuator, the through holes of the first, second and third plate members, the biasing member, the axial tunnel, and the handle.

The above and other objects, features and advantages of the invention will become apparent from the following detailed description taken with the accompanying drawings.

DETAILED DESCRIPTION OF THE INVENTION

Figure 1:
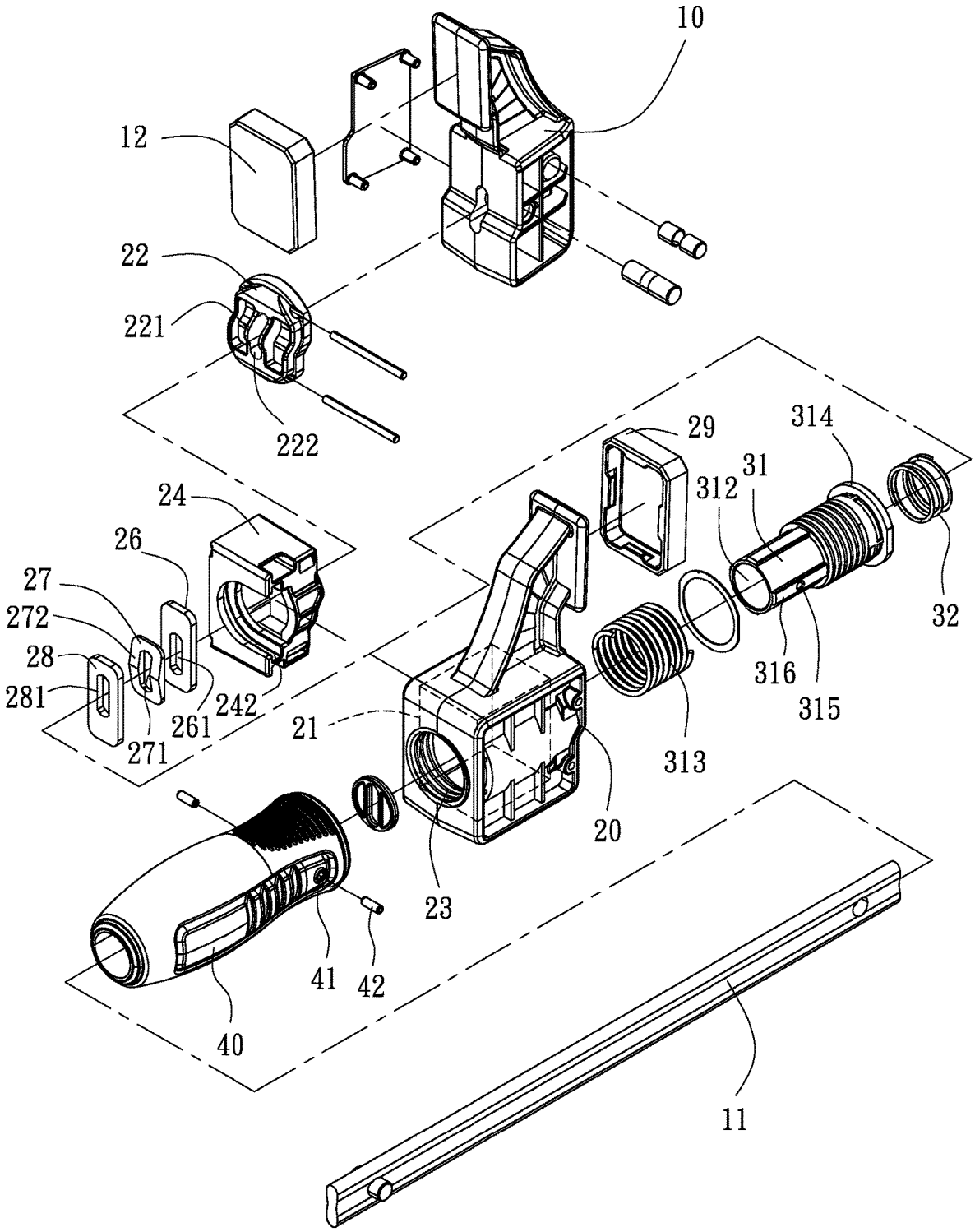
FIG. 1 is an exploded view of a vise according to the invention.
Figure 2:
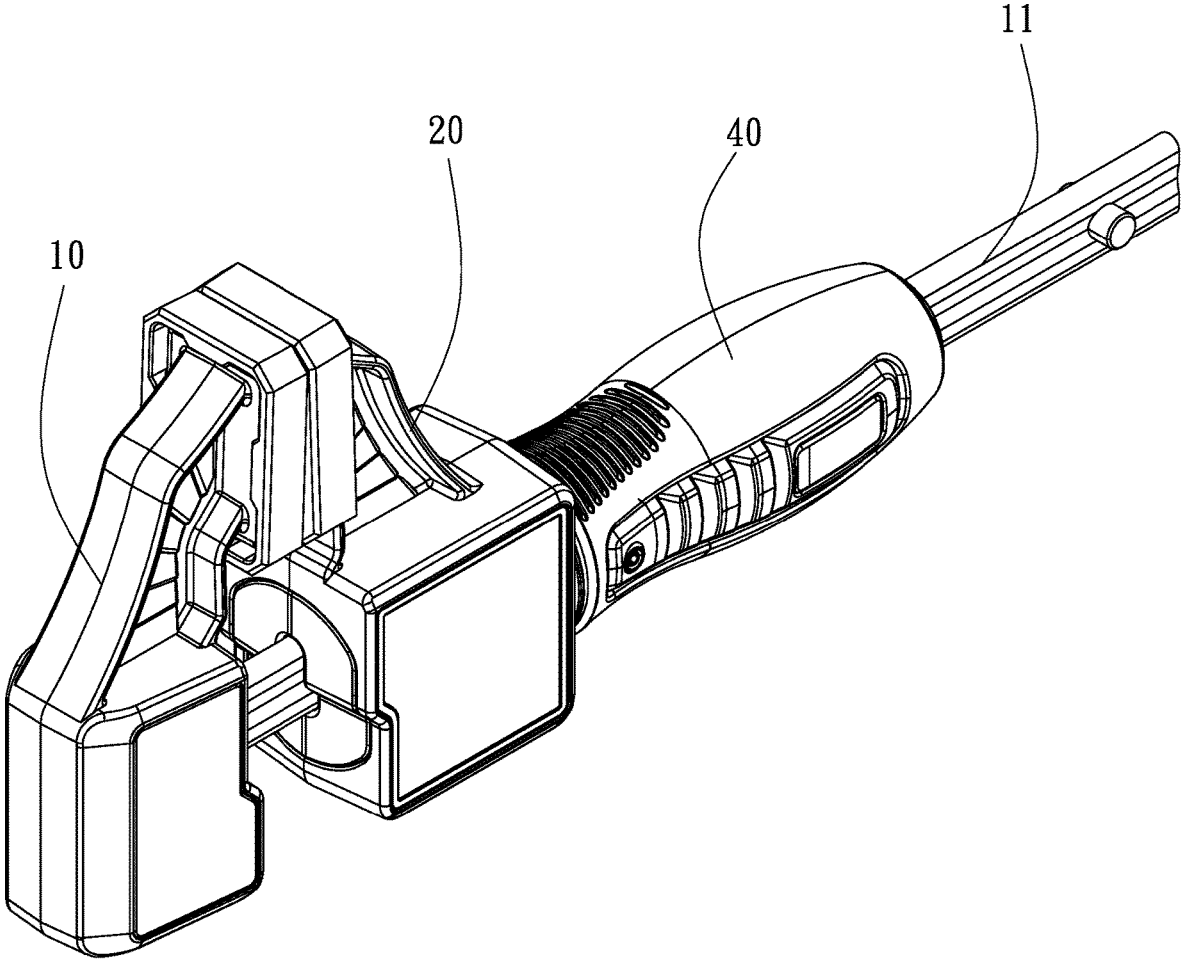
FIG. 2 is a perspective view of the assembled vise.
Figure 3:
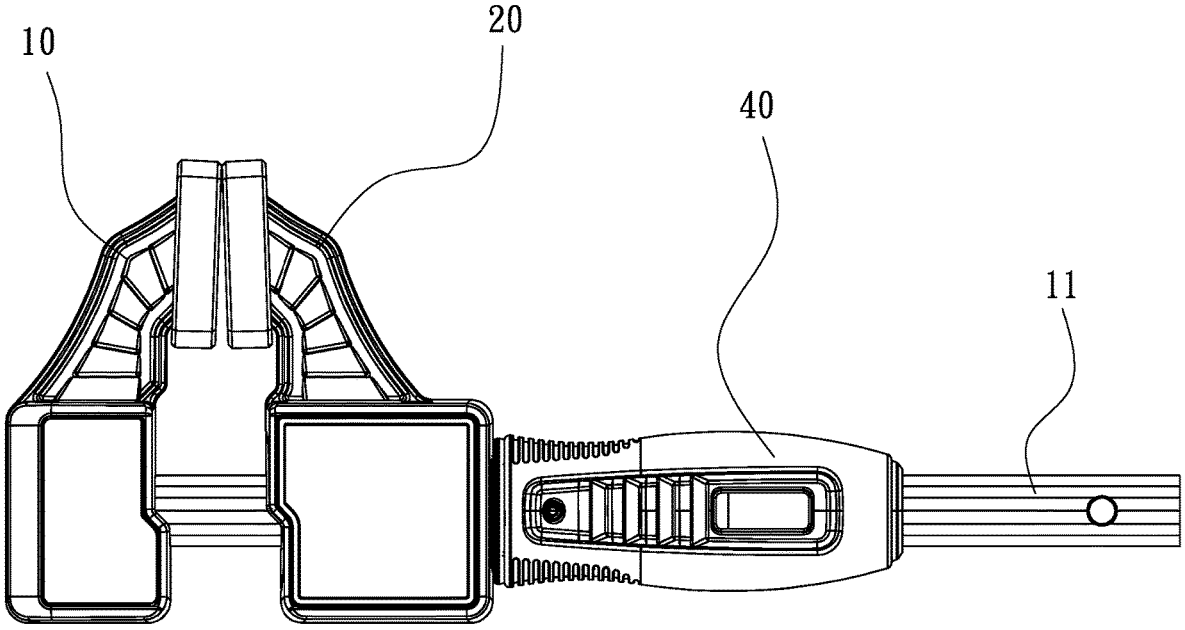
FIG. 3 is a side elevation of FIG. 2.
Figure 4:
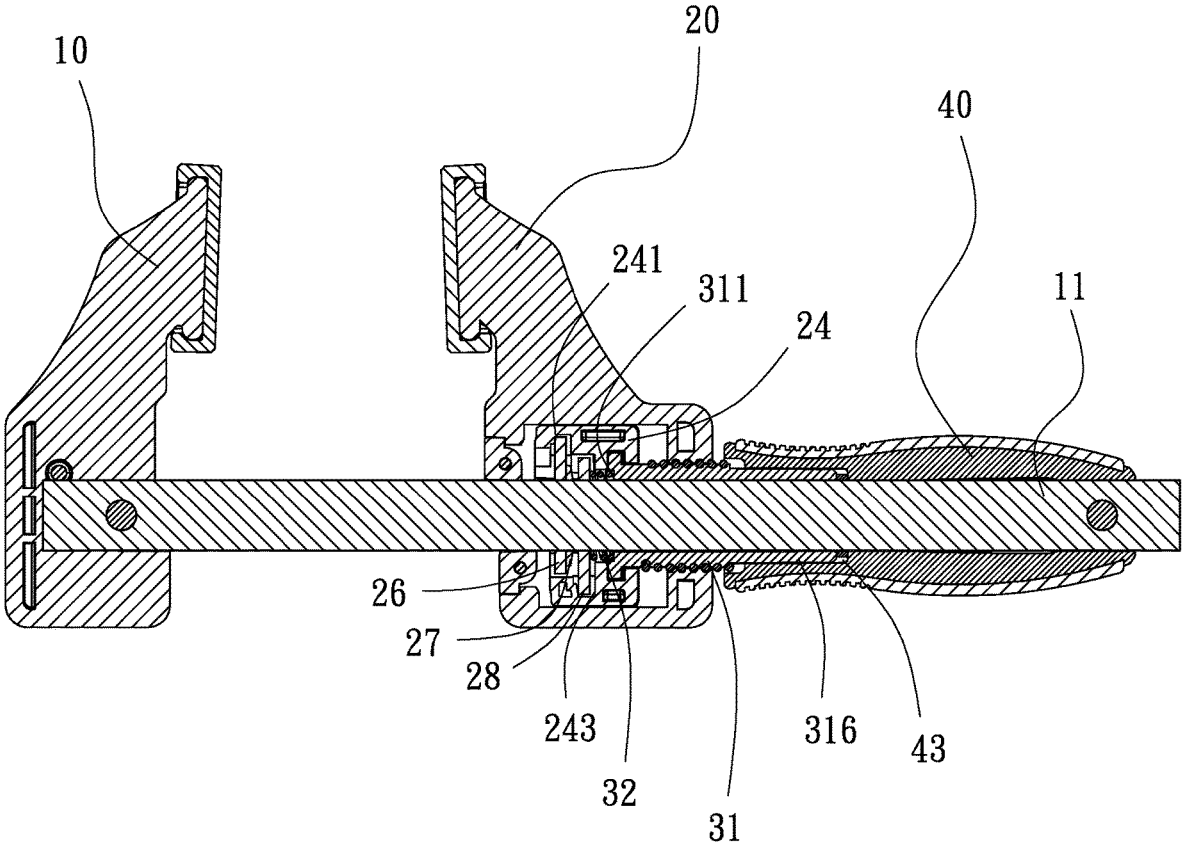
FIG. 4 is a longitudinal sectional view of the vise in an open state.

Referring to FIGS. 1 to 6, a vise in accordance with the invention comprises the following components as discussed in detail below.

A movable jaw 20 includes a lengthwise channel 21; a threaded hole 23 in a rear portion of the lengthwise channel 21; an actuator 22 in a front portion of the lengthwise channel 21 and having a rear, arcuate surface 221 and a through hole 222 through the rear, arcuate surface 221; a limit member 24 in an intermediate portion of the lengthwise channel 21 and having a front cavity 241, an intermediate cavity 243, and a rear groove 242; a first plate member 26 in the front cavity 241 of the limit member 24 and being adjacent to the actuator 22, the first plate member 26 having a through hole 261; a third plate member 28 in the intermediate cavity 243 of the limit member 24 and having a through hole 281; a second plate member 27 disposed between the first plate member 26 and the third plate member 28 and engaged with both the first plate member 26 and the third plate member 28, the second plate member 27 having a rear, convex surface 272 engaging the third plate member 28, and a through hole 271 through the rear, convex surface 272; and a clamping surface 29.

A slide sleeve 31 includes a front annular flange 314 disposed in the rear groove 242, a front recess 311 surrounded by the annular flange 314, an axial tunnel 312, a threaded member 313 fastened on an intermediate portion of the slide sleeve 31, four equally spaced keys 316 extending between the threaded member 313 and a rear end of the slide sleeve 31, and two opposite holes 315 through the keys 316. The slide sleeve 31 projects rearward out of the movable jaw 20. A helical spring 32 is partially disposed in the front recess 311 and urges against the third plate member 28. The threaded member 313 is partially threadedly fastened in the threaded hole 23 and has a portion extending out of the movable jaw 20.

A stationary jaw 10 includes a slide bar 11 extending rearward through the through hole 222 of the actuator 22, the through holes, 261, 271 and 281, the helical spring 32, the axial tunnel 312, and a handle 40; and a clamping surface 12. The handle 40 includes two opposite holes 41 aligned with the opposite holes 315, four spaced apart troughs 43 on a front portion of an inner surface with the keys 316 positioned therein, and two pins 42 driven through the opposite holes 41 and 315 to fasten the handle 40 and the slide sleeve 31 together. A front end of the handle 40 engages the threaded member 313.

Figure 5:
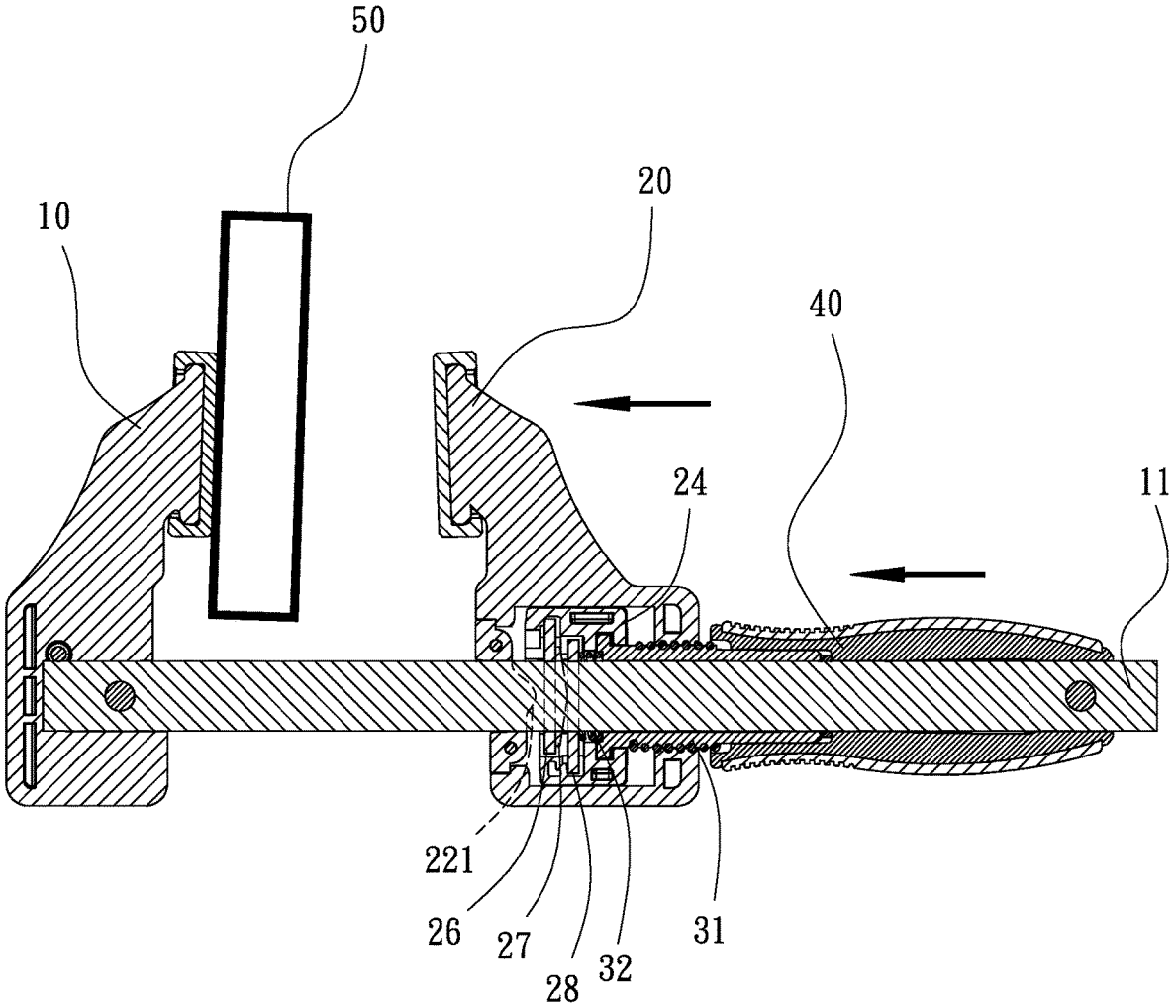
FIG. 5 is a view similar to FIG. 4 showing a workpiece being engaged with the stationary jaw.

As shown in FIG. 5 specifically, an individual may slidably push both the handle 40 and the movable jaw 20 to position a workpiece 50 between the clamping surface 12 of the stationary jaw 10 and the clamping surface 29 of the movable jaw 20.

Figure 6:
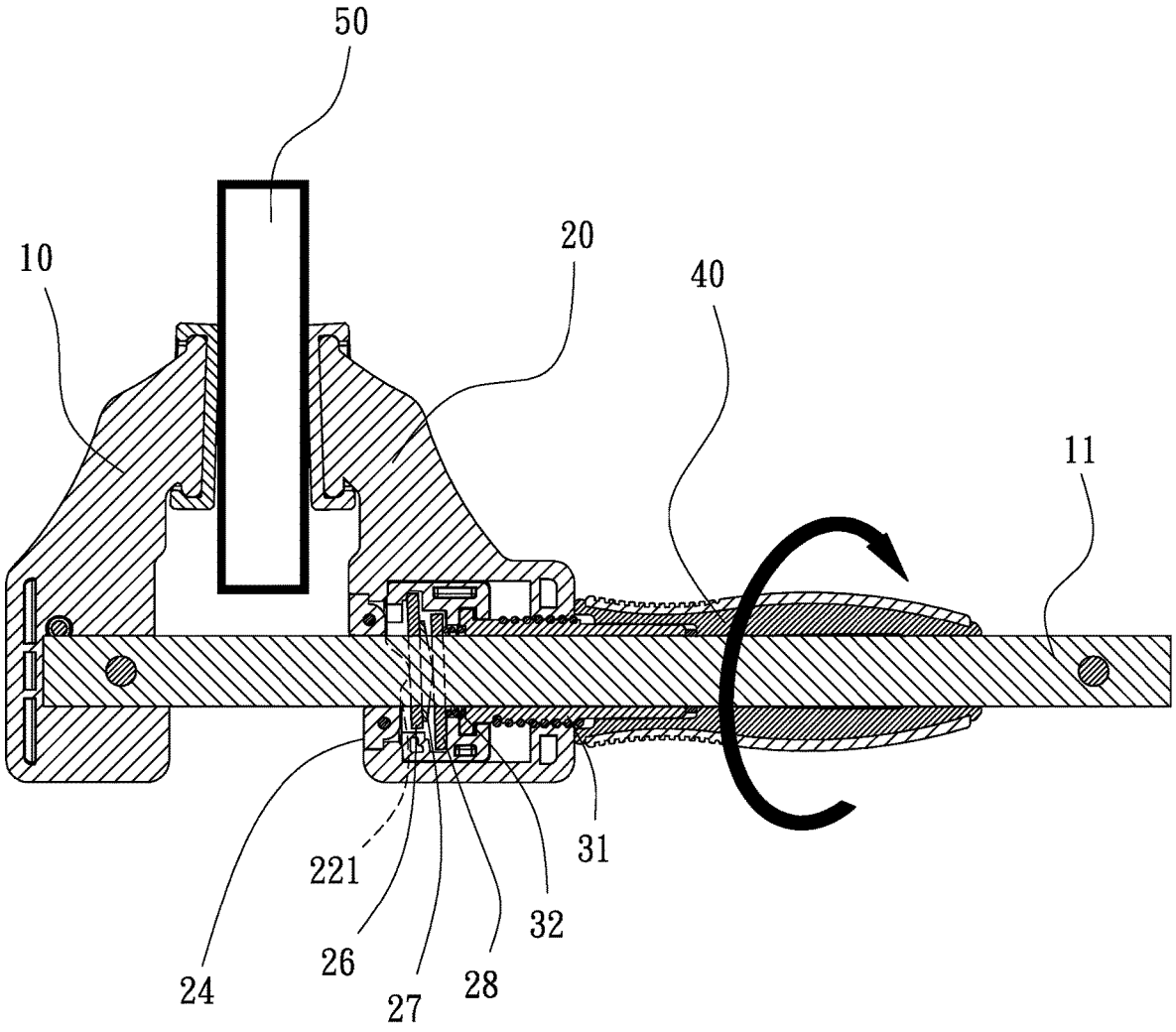
FIG. 6 is a view similar to FIG. 5 showing the workpiece being clamped by both the stationary jaw and the movable jaw by clockwise rotating the handle.

As shown in FIG. 6 specifically, the individual may further clockwise rotate the handle 40 to co-rotate the slide sleeve 31. And in turn, the movable jaw 20 moves further forward to clamp the workpiece 50 between the clamping surface 12 of the stationary jaw 10 and the clamping surface 29 of the movable jaw 20. Also, the slide sleeve 31 moves forward to push the limit member 24. Thus, the rear, arcuate surface 221 of the actuator 22 contacts the first plate member 26 and pushes both the first plate member 26 and the third plate member 28 rearward. As a result, both the first plate member 26 and the third plate member 28 are inclined. Thus, both the through holes 261 and 281 clamp the slide bar 11. As an end, the workpiece 50 is fastened by both the stationary jaw 10 and the movable jaw 20.

It is understood that a counterclockwise rotation of the handle 40 and a subsequent pulling of both the handle 40 and the movable jaw 20 can unfasten the workpiece 50.

While the invention has been described in terms of preferred embodiments, those skilled in the art will recognize that the invention can be practiced with modifications within the spirit and scope of the appended claims.

What is claimed is:

1. A vise, comprising:

a movable jaw including a clamping surface; a lengthwise channel; a threaded hole disposed in a rear portion of the lengthwise channel; an actuator disposed in a front portion of the lengthwise channel and having a rear, arcuate surface and a through hole through the rear, arcuate surface; a limit member disposed in an intermediate portion of the lengthwise channel and having a front cavity, an intermediate cavity, and a rear groove; a first plate member disposed in the front cavity and being adjacent to the actuator, the first plate member having a through hole; a third plate member disposed in the intermediate cavity and having a through hole; and a second plate member disposed between the first plate member and the third plate member and engaged with both the first and second plate members, the second plate member having a rear, convex surface engaging the third plate member, and a through hole through the rear, convex surface;

a slide sleeve including an axial tunnel, an intermediate thread threadedly secured to the threaded hole, a front annular flange disposed in the rear groove, a front recess surrounded by the annular flange, a biasing member partially disposed in the front recess and urging against the third plate member, a plurality of equally spaced keys extending between the intermediate thread and a rear end of the slide sleeve, and two opposite holes through the keys wherein the slide sleeve projects rearward out of the movable jaw;

a handle including two opposite holes aligned with the opposite holes, a plurality of spaced troughs on a front portion of an inner surface with the keys positioned therein, and two fasteners driven through the opposite holes to fasten the handle and the slide sleeve; and a stationary jaw including a clamping surface and a slide bar extending rearward through the through hole of the actuator, the through holes of the first, second and third plate members, the biasing member, the axial tunnel, and the handle.

* * * * *